United States Patent [19]

Salvarezza

[11] Patent Number: 4,554,996

[45] Date of Patent: Nov. 26, 1985

[54] ROPE LADDER WITH MOLDED HARD ELASTOMER STEPS AND REPLACEMENT STEPS AND COLLARS THEREFOR

[76] Inventor: Robert M. Salvarezza, 110 Braemar Dr., Hillsborough, Calif. 94010

[21] Appl. No.: 722,859

[22] Filed: Apr. 12, 1985

[51] Int. Cl.[4] ..... E06C 1/56

[52] U.S. Cl. ..... 182/199; 182/46

[58] Field of Search ..... 182/46, 196, 197, 198, 182/199

[56] References Cited

U.S. PATENT DOCUMENTS

| | | | |
|---|---|---|---|
| 3,415,341 | 12/1968 | Hostetler | 182/199 |
| 4,177,878 | 12/1979 | Salvarezza | 182/199 |
| 4,241,809 | 12/1980 | Salvarezza | 182/199 |
| 4,442,920 | 4/1984 | Gronbeck | 182/46 |

FOREIGN PATENT DOCUMENTS

| | | | |
|---|---|---|---|
| 2031983 | 4/1980 | United Kingdom | 182/199 |

*Primary Examiner*—Reinaldo P. Machado

*Attorney, Agent, or Firm*—Owen, Wickersham & Erickson

[57] ABSTRACT

A rope ladder in which the steps have a metal frame comprising a pair of longitudinal members joined by a pair of shorter transverse members spaced in from the ends and strengthened by a pair of diagonal members. At each end a metal bracket bridges across the frame and provides an elevated upper plate portion which defines a generally rectangular opening. A molded hard elastomer body is molded around the frame and has a collar portion at each end molded around the bracket. The body has a downwardly and outwardly flaring through opening in line with the bracket opening and vertical bolt openings therethrough adjacent each through opening. A separate wedge collar for each step has a tapered through opening going down to a narrow lower end. A generally diamond-shaped wedge heart in between each pair of ropes provides two rope-engaging side grooves for locking the pair of ropes in place and preventing relative movement between the ropes and the step, when fastening means extending through the bolt openings are tightened in place.

21 Claims, 17 Drawing Figures

FIG. 1
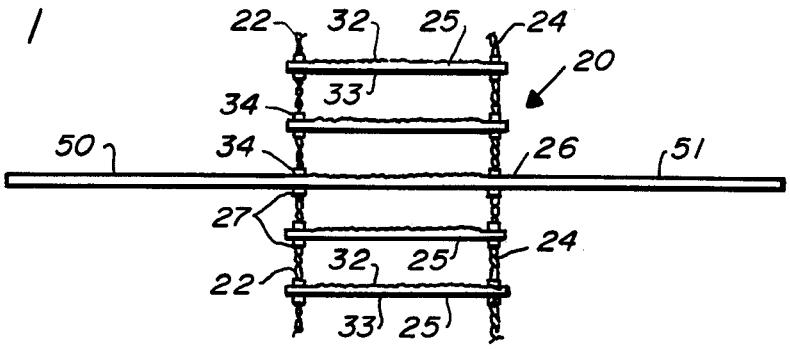
FIG. 2
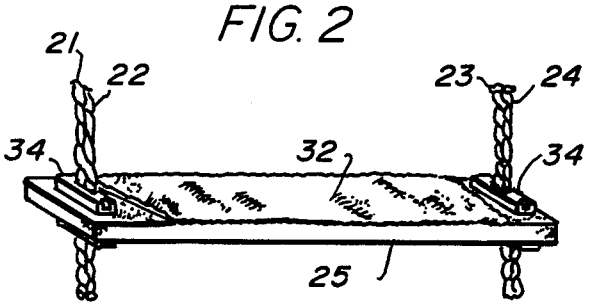
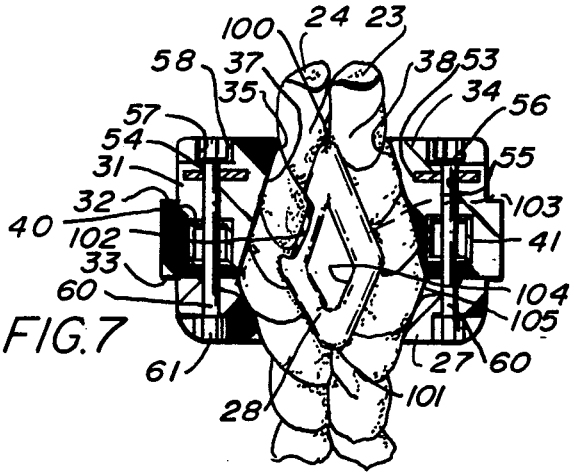
FIG. 7
FIG. 3
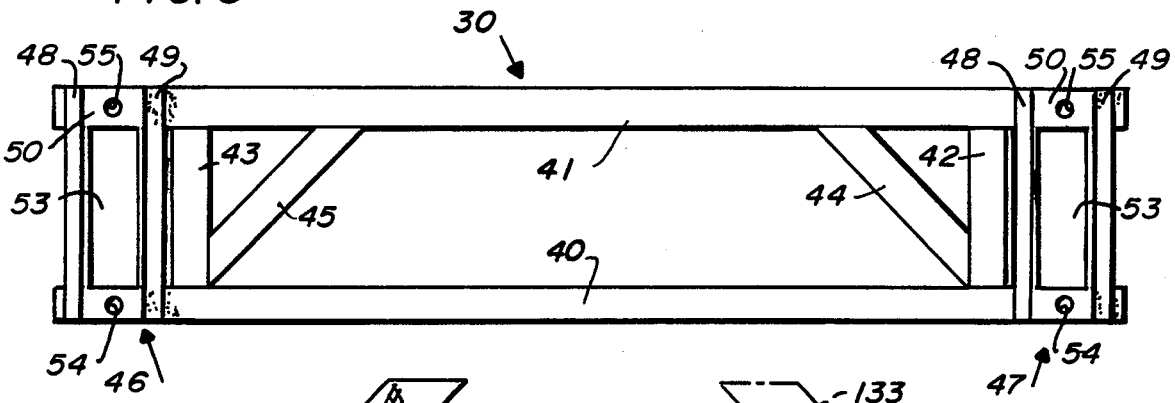
FIG. 10
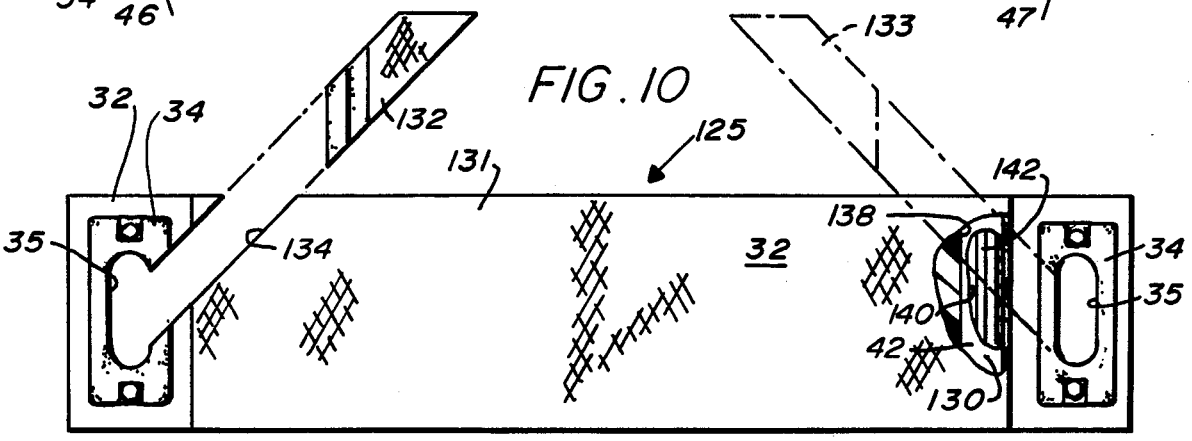

FIG. 4
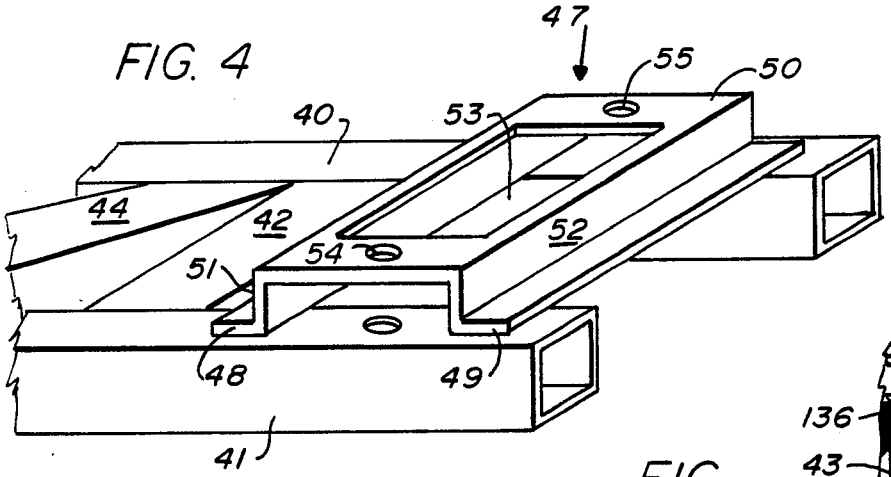
FIG. 13
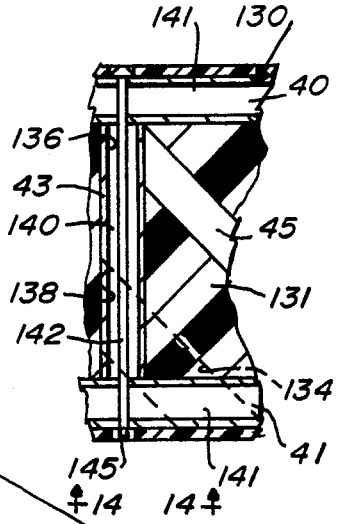
FIG. 5
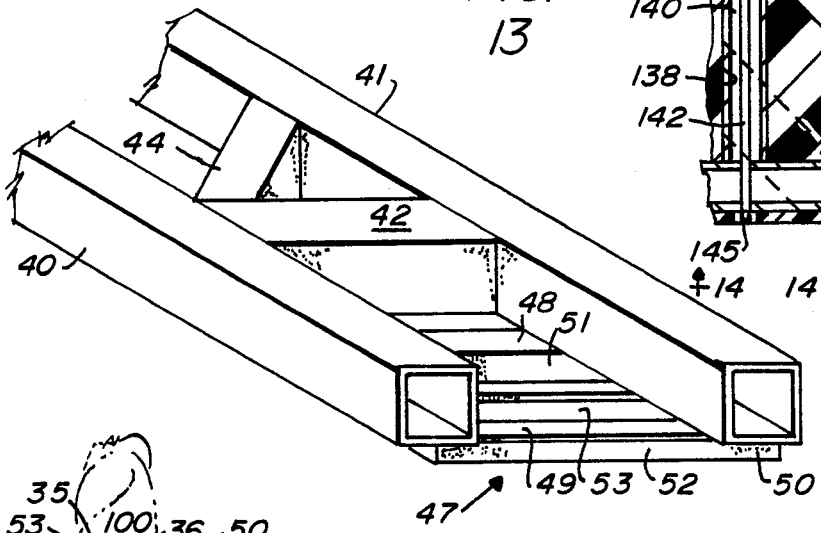
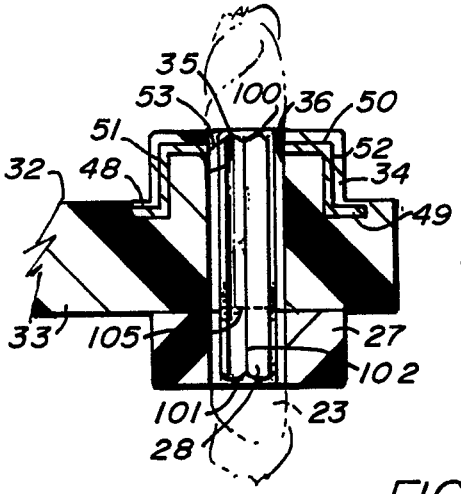
FIG. 8
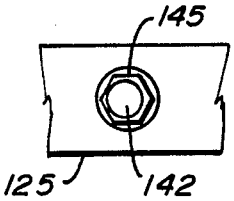
FIG. 14
FIG. 9
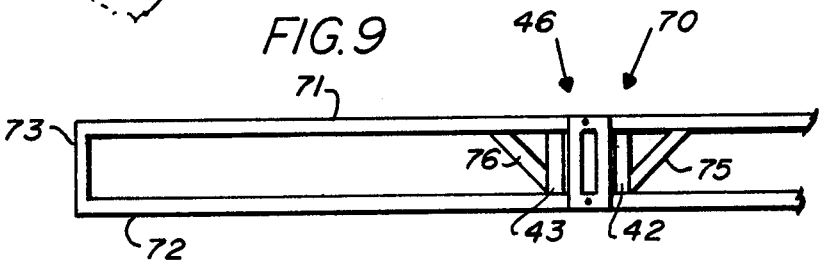

ROPE LADDER WITH MOLDED HARD ELASTOMER STEPS AND REPLACEMENT STEPS AND COLLARS THEREFOR

This invention relates to an improved rope ladder and to a novel step therefor, as well as to a novel replacement step and a novel replacement collar and to repair of the ladder by replacement of some of its parts.

BACKGROUND OF THE INVENTION

Rope ladders, which are especially useful as pilot's ladders by which a local pilot boards or leaves a ship, used to be made with wooden or metal steps until my earlier inventions, shown in U.S. Pat. Nos. 4,177,878 and 4,241,809, incorporated a molded elastomer step of a hard rubber-like material. The present invention relates to improvements in that type of ladder.

Those patents disclose and claim a rope ladder of the type in which there are two ropes on each side of each molded step, and a wedging structure is used to make the attachment between each step and the ropes secure. However, the molded steps sometimes proved weaker than was desired for long life. In the present invention, I incorporate a strong metal frame having a special shape around which is molded the body of the step.

The breakage and non-uniformity of wooden steps had long been a problem, and the use of molded elastomer in my earlier patents greatly reduced breakage and gave improved quality control. Also, the elastomer had more resilience and so better received strong impacts. When improved according to the present invention, the step will not flex or bend under average work load, but on the other hand the molded portion especially can yield to very strong loads or impacts without actually breaking.

However, under some conditions any steps can break or be unduly weakened. Heretofore, replacement of even one step meant taking the whole ladder apart and putting it back together. Therefore, an object of the present invention is to provide a novel replacement step that can be installed without having to take the whole ladder apart.

Sometimes the collars used as part of the wedging structure are broken or damaged severely, and the present invention solves that replacement problem too.

SUMMARY OF THE INVENTION

The rope ladder of this invention has a series of molded, one-piece ladder steps, each with an upper surface and a lower surface, two longitudinal edges and two end edges, and each step has two spaced-apart vertical through openings. one spaced in from each transverse edge. These steps are used with two spaced-apart pairs of ropes, each pair of ropes passing through one through opening of each step. At intervals, there are also spreader steps.

Each step is molded from hard elastomer about a strong metal frame or core having a special shape that gets nearly maximum strength for the purpose at near-minimum weight, using lightweight metal alloy. Most of the frame is made from tubular stock, preferably square in cross-section, to achieve great strength with light weight. A pair of longitudinal tubes meet and extend beyond a transverse tube at each end, and the portion extending beyond the transverse tube is surmounted by and welded to a special metal bracket. Inboard of each transverse tube, a strengthening tube extends diagonally from one end of the transverse tube to the longitudinal tube that is at the other end of the transverse tube.

Special consideration is given to the area through which the rope passes. Around each rope opening, each molded step has an integral rope-surrounding portion, including the metal frame bracket, which sorrounds that opening, and a molded collar-like portion extending above the step's upper surface. The molded collar-like portion defines at its upper end an opening approximately twice as long as the diameter of each rope and only about as wide as that diameter, so that the two ropes are closely confined there. The opening then increases in length transversely of the step, and at the lower surface of the step is much longer, so that each opening is tapered outwardly in length from the top to the bottom; the width of each opening remains constant. Each step also has a pair of vertical bolt openings therethrough adjacent each through opening, and these bolt openings pass through the metal frame bracket.

As in U.S. Pat. No. 4,241,809 a pair of separate wedge collars is used for each step, one below each of the through openings, bearing up against the step. I have found that the wedge collar may either be made of metal or of strong light plastic, such as polyurethane or nylon. Each wedge collar has a step-engaging end wall and a distal end and a single elongated through opening, through which one pair of ropes passes and which at said step-engaging end is approximately the same width as the bottom end of the opening through the step, where it abuts the collar. The through opening through the wedge collar tapers inwardly down to a narrower portion of the opening at the bottom, which is barely wide enough for the two ropes to pass therethrough. Each wedge collar has an elongated pair of vertical bolt passages therethrough aligned with the bolt openings through the step.

As in my earlier patents, a generally diamond-shaped wedge heart lies in between the ropes of each pair, a wedge heart lying partly in the through opening of each step and extending into the adjacent opening through the wedge collar. The wedge heart has an upper vertex spaced away from the upper outlet of the step's opening and a lower vertex at its lower end spaced away from the bottom of the opening through the wedge collar. The wedge heart provides two rope-engaging side grooves extending between and ending at these vertices; these grooves are, in the assembly, parallel to the opposite walls of the openings through the step and collar, respectively, so that these rope-engaging grooves, when the wedge heart is fully wedged in place, lock the pair of ropes in place and prevent relative movement between the ropes and the step, the wedge collar, and the wedge heart.

A pair of bolts, each fastened with a nut, extend through the bolt passages of the wedge collar and the bolt openings of the step, and hold the wedge collar, and therefore the wedge heart in place, locking the ropes in fixed position relative to the wedge heart, the step, and the wedge collar. There is one bolt just beyond each end of the transverse through opening.

In the present invention, a replacement wedge collar is provided. Preferably this is made so that certain portions are thickened to provide more strength, while the rope opening through it is not fully enclosed, for there is an access slot that enables rapid replacement around the rope.

As stated earlier, the invention also provides for replacement steps. In such steps a diagonal slot is provided inboard from each pair of ropes from one longitudinal edge of the step, along with structure which fills that slot when the step is fully installed. The slot is preferably parallel to the strengthening diagonal tube of the frame. The diagonal slots lead into the rope passages and enable rapid installation without disassembly and reassembly of the whole ladder. The slot-filling structure, when replaced, is bolted in place, and the replacement step is strong and remains in place without danger of accidental removal. The replacement collar is made so that it strengthens the replacement step at the place when the slot-filling structure is located.

The steps known as "spreader steps" are considerably elongated at each end. These, too, have been improved by provision of the frame, whether or not the spreader step is an original step or a replacement step, both being provided by this invention.

BRIEF DESCRIPTION OF THE DRAWINGS

In the drawings:

FIG. 1 is a view in front elevation of a portion of a rope ladder embodying the principles of the invention and showing an elongated spreader step in between several normal-length steps.

FIG. 2 is a fragmentary isometric view of one of the steps of the ladder, showing the ropes and other parts of the assembly.

FIG. 3 is a top plan view of the frame of a ladder step.

FIG. 4 is a fragmentary enlarged isometric view of one end of the step frame of FIG. 3.

FIG. 5 is a similar view looking from a viewpoint at about 90° from that of FIG. 4, but from the other side of the step.

FIG. 7 is an enlarged fragmentary vertical sectional view of the wedge-collar-step assembly.

FIG. 8 is a sectional view taken at right angles to FIG. 7, omitting the rope.

FIG. 9 is a fragmentary top plan view of about half of the frame for one of the spreader steps.

FIG. 10 is a top plan view of a completed replacement step as molded on the frame of FIG. 3, with one of the the removable portions removed and the other in place. A portion of the step is broken away to show the structure beneath.

FIG. 13 is a fragmentary horizontal section of a portion of the replacement step of FIGS. 10 and 11.

FIG. 14 is a fragmentary view in side elevation looking along the line 14—14 in FIG. 13.

DETAILED DESCRIPTION OF THE INVENTION

A standard ladder

Figure 11:
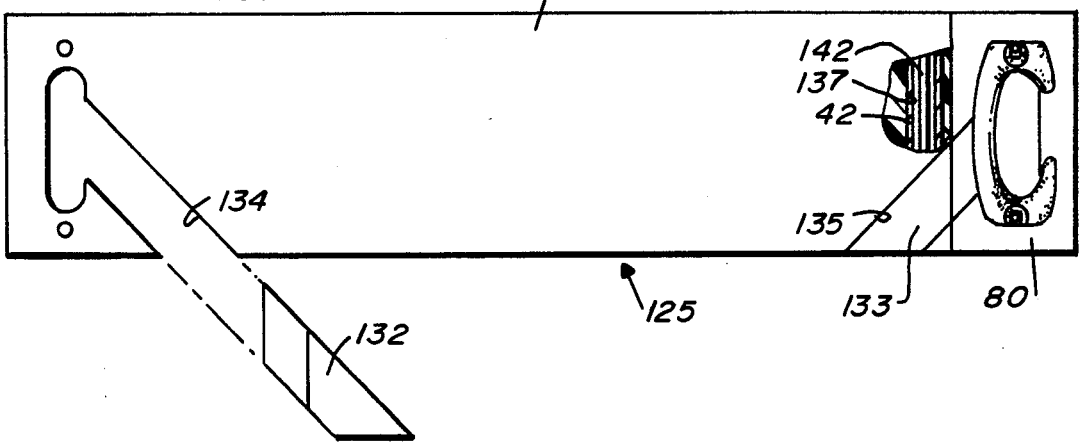
FIG. 11 is a similar bottom plan view of the replacement step of FIG. 10 with one end having the removable portion fully in place and with its collar in place and the other end with the removable part removed and no collar. A portion is broken away to show the structures beneath.

FIG. 1 shows a portion of a rope ladder 20 embodying the invention. The ladder 20 is especially useful as a pilot's ladder for boarding and leaving ships and comprises four ropes (See FIG. 2) distributed as two pairs of ropes 21, 22 and 23, 24, one pair at each side of the ladder 20. The ladder 20 further comprises a series of regular steps 25 and, at intervals usually as prescribed by the United States Coast Guard, a series of elongated spreader steps 26, which extend out well beyond the rope pairs 21, 22 and 23, 24, and help to keep the ladder 20 from turning or twisting relative to the side of a ship. In addition, as shown in FIG. 7, the invention comprises near each end of each step 25 a wedge collar 27 and a wedge heart 28; each spreader step 26 also employs a collar 27 and wedge heart 28.

Original equipment steps 25

Figure 6:
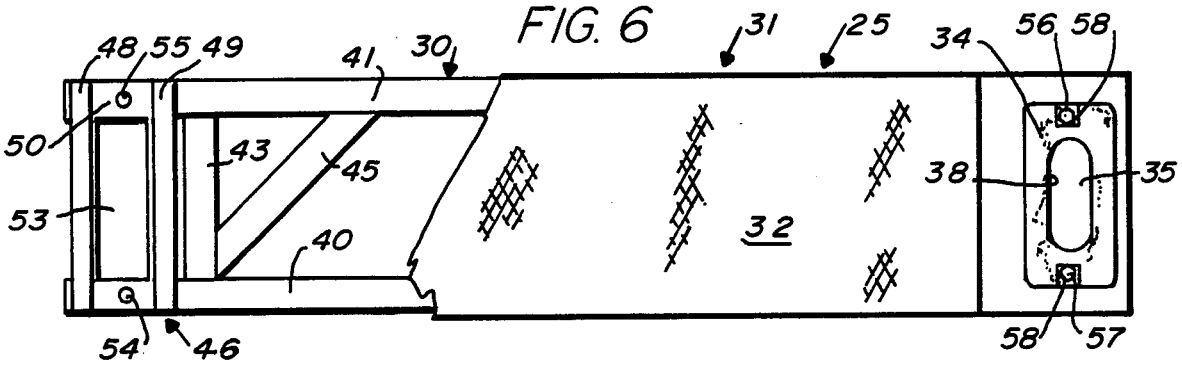
FIG. 6 is a view of a completed step, molded about the frame of FIGS. 3–5, with the molded portion broken away from one side to show the frame.
Figure 12:
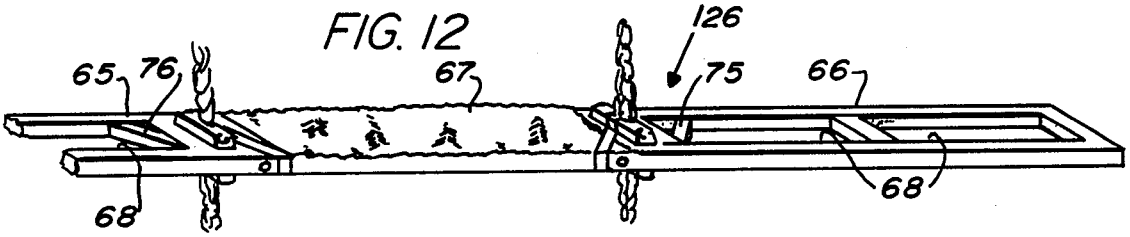
FIG. 12 is a fragmentary top plan view of a completed replacement spreader step, with the end of the left half portion broken off.

Each step 25, as shown in FIG. 6, comprises a metal frame 30 about which is molded a body 31, preferably of a suitable hard elastomer, such as a hard synthetic rubber composition. The body 31 has some flexibility but is not readily bent or flexed by hand. The body 31 has an upper tread surface 32 (See FIGS. 1 and 6), which is shaped and surfaced to reduce the likelihood of skidding or sliding thereof. The non-skid aspect of the upper surface 32 may be enhanced by first spraying a suitable paint of a type which will adhere to that surface, then adding to it grit and then coating it with paint again so as to bond the grit to the paint and, through it, to the step 25. Each step 25 (See FIG. 1) also has a lower surface 33.

At each end of each step 25 (See FIG. 6, right side, and FIGS. 1, 2, and 7) is an integral raised molded collar portion 34. The integral collar portions 34 extend up from the step's top surface 32 and are in line with the separate collars 27, which abut the bottom surface 33. Each integral collar 34 encompasses a through opening 35 which extends through the step 25 at and below the collar portions 34. The through openings 35 have vertical transverse walls 36 and tapering end walls 37, so that at the upper end 38 of the collar portion 34, the opening 35 is barely wide enough to accommodate the two ropes, while at the bottom 33, the opening 35 is considerably wider and therefore enables use of the wedge heart 28 between the two ropes 21, 22, or 23, 24.

The frame 30, which can be seen in FIGS. 3–6, preferably is made largely of thin but strong metal tubing, preferably square in cross-section. There are two longitudinal tubes 40 and 41; spaced inboard from each end are transverse tubes 42 and 43 that are each welded to the tubes 40 and 41. Diagonally-extending tubes 44 and 45 strengthen the structure; one end of each tube 44, 45 is welded to a transverse tube 42 or 43 near where they meet the longitudinal tube 40, and the other end is welded to the other longitudinal tube 41.

At each end of the frame 30, a metal bracket 46 or 47 surmounts and is welded to the longitudinal tubes 40 and 41. Each bracket 46, 47 (See FIGS. 4 and 5) has bottom flanges 48 and 49 that are welded to the tubes 40 and 41 and are connected to an upper plate portion 50 by vertical portions 51 and 52. The upper plate portion 50 surrounds and defines an opening 53 corresponding to the through opening 35, the metal therearound strengthening that portion of the step 25. The upper plate portion 50 also provided with a pair of bolt openings 54 and 55, one at each end. Corresponding openings pass through the longitudinal tubes 40 and 41. The molded step 25 is likewise provided with aligned and corresponding bolt openings 56 and 57, the collar-like portion 34 also providing recesses 58 to receive a bolt head.

The wedge heart 28 (FIG. 7) is of generally diamond shape, having a vertex 100 at the top and a vertex 101 at the bottom and with concave rope guides or grooves 102 and 103 along its two opposite edges. If made of metal, it may be hollow, its diamond shape having an opening 104 therethrough; if made of polyurethane it may be solid. Each wedge heart 28 is inserted between a pair of two ropes 21, 22 or 23, 24 and lies with its widest portion 105 at about the plane where the lower surface 33 of the step 25 and the upper surface of the wedge collar 27 meet; its upper apex 100 lies a short distance below the upper face of the collar-like portion 34 while its lower apex 101 lies a short distance above the lower face of the wedge collar 27. When fully wedged in place, the grooves 102 and 103 are generally parallel to the curved end walls of the openings 35 through the step 25 or 26 and to the curved end walls of the opening through the wedge collar 27. The heart 28 then locks the step 25 (or 26), the wedge collar 27, and itself to the ropes 21, 22 or 23, 24, so that relative movement between them cannot take place.

The frame brackets 46 and 47 thus cooperate with the longitudinal tubes 40 and 41 to strengthen the step 25 in the area of the rope passages 35 and 53. When the completed step 25 is assembled into the ladder 20, bolts 60 pass through the openings 54, 55, 56, and 57, and nuts 61 tighten the collars 27 against the bottom surface 33 of the step 25 and assure that the ropes 21, 22, 23, and 24 will be locked in place by the wedges 28, in cooperation with the shaped ends walls 37 of the openings 36. Moreover, the cross-tubes 42 and 43 and the diagonal tubes 44 and 45, being welded to the longitudinal tubes 40 and 41, support the body 31 of the molded step and strengthen the whole.

As a result of the frame structure, the steps 25 and 26 and the ladder 20 are much superior to former structures.

For a pilot's ladder 20, the steps 25 are about twenty inches long, about five inches wide, and about an inch thick at the tread.

Original equipment spreader steps 26

The elongated spreader steps 26 are generally like the steps 25, but they have outboard portions 65 and 66 on each side of a central portion 67. There are hollow with openings 68 that provide handholds. As shown in FIG. 9 each spreader step 26 has a unitary frame 70, with two very long longitudinal tubes 71 and 72 like the tubes 40 and 41 welded to transverse end tubes 73 and to intermediate cross tubes 74 that correspond in position to the transverse tubes 42 and 43. Diagonal tubes 75 are positioned exactly as the members 44 and 45 of the step 25, and brackets 46 and 47 are mounted in the rope area just as before. Additional diagonal braces 76 are preferably employed outboard of the members 44 and 45 and symmetrical to the braces 75 with respect to the brackets 46 or 47. The central portion 67 that corresponds to the step 25 is identical to that portion; only the outboard portions 65 and 66 are hollow and provide handholds. The handhold structure saves material and lightens the step 26, while increasing its effectiveness.

The elongated spreader steps 26 are typically about seventy inches long, and the handhold openings about two inches by eight inches when there are two openings on each side of each central portion 67. For a forty-foot ladder, there are usually four of the elongated or spreader steps 26.

In addition to serving their usual functions, the spreader steps 26 solve several problems. Conventional wooden spreaders tend to catch the wind, and when they do, they tend to cause the ladder to twist or spin, thereby making ascent or descent dangerous, if not impossible. The openings 68 let the wind pass through the outboard positions 65 and 66 and greatly reduce the wind resistance, thereby significantly increasing the ladder's safety. Furthermore, as indicated the rims around the openings 68, serve as handholds when needed, as on windy days and nights, thereby adding another safety feature. Beyond all this, the openings 68 lighten the weight of the ladder 20 considerably, and width is always a consideration for pilot ladders. On a forty-foot ladder 20 with four spreader steps 26, the open area is about $2'' \times 8''4 \times 4 = 256$ square inches, and at one inch thick, this open area is equivalent to reducing the weight by the weight of a $4'' \times 1''$ board about five and one-half feet long thick, this open area is equivalent to reducing the weight by the weight of a $4'' \times 1''$ board about five and one-half feet long.

Figure 15:
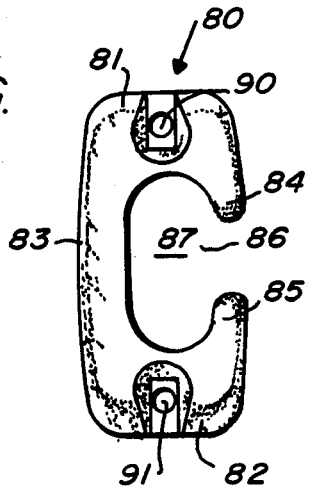
FIG. 15 is an enlarged bottom view of one of the replaceable collars of the present invention.
Figure 16:
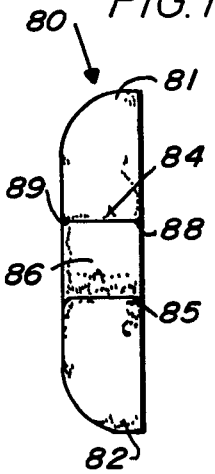
FIG. 16 is a view in side elevation of the collar of FIG. 15.
Figure 17:
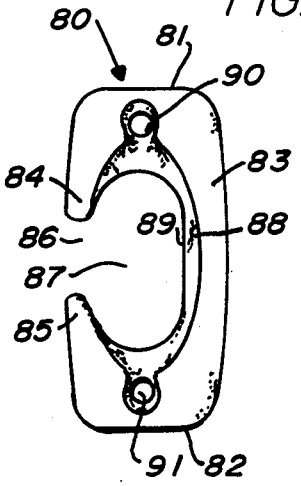
FIG. 17 is a top view of the collar of FIGS. 15 and 16.

Replacement wedge collar 80 (FIGS. 15–17)

The wedge collar 27 previously described may be a unitary metal member or a polyurethane or other suitable plastic member. Should such a collar 22 be badly damaged or broken, it is readily removed, as by sawing, but to replace that discarded collar 27 is another matter. To replace it with an identical collar would require disassembly and reassembly of the ladder 20.

The present invention provides a special replacement collar 80, preferably of strong light metal or strong light plastic such as nylon, that can be placed on the ladder 20 at any location without tampering with the rest of the ladder. Each wedge collar 80 has thick end walls 81 and 82 joined by a thick side wall 83 at one side. On the other side are spur wall portions 84 and 85, narrower than the wall 83 and separated from each other by a slot 86 leading into a main through opening 87. The through opening 87 has vertical sides, a wide upper end portion 88, and a narrower lower end portion 89, with a tapered as well as curved end surface in between. The wide portion 88 is preferably exactly the same size as the lower end of the opening 35 at the bottom of the step 25 since it will mate against it.

Due to the slot 86, the collar 80 is readily removable from the ropes 21, 22 or 23, 245 when the bolts 60 and 61 are removed from its bolt openings 90 and 91.

The replacement steps 125 and 126 (FIGS. 10–14)

An important feature of the present invention is the ease with which any steps 25 or 26 of the ladder 20 can be replaced. for this purpose special replacement steps 125 (FIGS. 10 and 11) and 126 (FIG. 12) are provided, corresponding to the step 25 and 26. The replacement steps 125 have a frame 130 substantially identical to the frame 30 and a molded body 131 like the body 31. However, as shown in FIGS. 10 and 11, two diagonal fillers 132 and 133 are provided to fit into respective diagonal slots 134 and 135, that is cut through the step 125 and its frame 130, extending inboard from the and intersecting the rope receiving through opening 35. The slots 134 and 135 are parallel to the diagonal reinforcing frame member 44 and 45 thereadjacent and cut through the transverse members 42 and 43 and the longitudinal tube 40. A transverse bolt opening 136 (FIG. 13), 137 (FIG. 11) extends through the frame 130, through both the tube 41 and the tube 40 in line with the central passage 140 inside the transverse tube 42 or 43, via passages 141 through the tubes 40 and 41. The fillers 132 and 133 have openings 138 that can each be aligned with the openings 136, 137, so that bolts 142 hold the fillers 132 and 133 in place.

Thus if a step 25 is damaged, it may be readily removed by sawing across end walls of the collar portions 34 (after removal of the bolts 60 and 61, the collars 27, and the wedges 28). Then replacement of step 125 can be placed on the ropes 21, 22, and 23, 24, using the open slots 134 and 135. The collar 27 if not damaged, may be re-installed, along with the bolts 60 and 61 and the wedges 28. Then the diagonal filler portions 132 and 133 are put in place, and the bolts 142 are installed to pass through the frame passage 140, openings 41, the openings 138 through the filler portions 132 and 133, the frame 130 and the openings 136 and 137 through the molded portion 131 of the step 125. Nuts 145 are then tightened and hold the bolts 142 in place.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. In a rope ladder of the type having a series of ladder steps, and two spaced-apart pairs of ropes, a metal step frame with a pair of longitudinal members joined by a pair of shorter transverse members spaced in from the ends and strengthened by a pair of diagonal members, and having at each end a metal bracket bridging across the pair of longitudinal members and having vertical portions leading to an upper plate portion, which defines a generally rectangular opening, a molded hard elastomer body molded around said frame and having a collar portion at each end molded around a said bracket, said body having a through opening through each collar portion and the body therebelow and in line with the openings through said brackets, each said through opening being narrow at its upper end for closely confining said pair of ropes and widening out toward its lower end each through opening tapering inwardly from bottom to top, each said step having vertical bolt openings therethrough adjacent each said through opening, and a pair of separate wedge collars for each said step, one at each end of and below said step and bearing up against it, each said wedge collar having a through opening whose upper end is approximately the same width as said step's through opening where it emerges from its lower surface, said collar's through opening tapering inwardly therefrom down to a narrow portion at the lower end for closely confining the two ropes, each said wedge collar having vertical bolt passages therethrough aligned with the bolt openings through said step, a generally diamond-shaped wedge heart in between the said ropes of each pair of ropes, in said through openings, said wedge heart providing two rope-engaging side grooves for locking the pair of ropes in place and preventing relative movement between them and said step, and fastening means extending through said bolt passages and bolt openings and tightened in place to hold said wedge collar and wedge heart in place and lock said ropes in fixed position relative to said step.

2. The ladder of claim 1 having at intervals along said ropes a spreader step having a central portion like an aforesaid step but with a pair of outboard portions that include extended integral portions of said longitudinal frame members joined at their outboard ends by transverse frame members, said molded body being molded around said extended portions of said longitudinal frame portions and having openings through each said outboard portion between said extended portions to provide handholds, lightness, and wind passages therethrough.

3. A replacement wedge collar for a ladder of claim 1, each said replacement wedge collar having a slot on one side leading into said through opening.

4. The collar of claim 3 wherein the side opposite said slot is greatly thickened.

5. A replacement step for a ladder of claim 1 like the step set forth therein with the addition of:

a diagonal slot adjacent to and parallel to each said diagonal frame member, and through both said frame and step, a filler member filling said slot, and fastening means extending transversely through said step and through said filler member to hold it in place removably.

6. A rope ladder of the type having a series of ladder steps, each with an upper surface and a lower surface, two longitudinal edges and two end edges, and two spaced-apart pairs of ropes, the improvement wherein each said step has:

a unitary metal frame with a pair of longitudinal members joined by a pair of shorter transverse members and strengthened by a pair of diagonal members, each extending from one end portion of a transverse member to the longitudinal member that is joined to the opposite end of the transverse member, all said longitudinal, transverse, and diagonal members being welded together, said frame also having at each end a metal bracket resting atop and welded to and bridging across the pair of longitudinal members outboard of said transverse members, said brackets having vertical portions leading up to an upper plate portion, which defines a generally rectangular opening, a molded hard elastomer body molded around said frame and having a collar portion at each end molded around a said bracket, said body having two spaced-apart vertical through openings, one through each collar portion and the body therebelow and in line with the openings through said brackets, each said through opening being narrow at its upper end for closely confining said ropes and being much wider than that where it emerges from said lower surface, each through opening tapering inwardly from bottom to top, each said step having vertical bolt openings therethrough adjacent each said through opening, extending through both said frame and said body, a pair of separate wedge collars for each said step, one at each end of and below said step and bearing up against it, each said wedge collar having a through opening whose upper end is approximately the same width as said step's through opening where it emerges from its lower surface, said collar's through opening tapering inwardly therefrom down to a narrow portion at the lower end for closely confining the two ropes, each said wedge collar having vertical bolt passages therethrough aligned with the bolt openings through said step, a generally diamond-shaped wedge heart in between the said ropes of each pair of ropes, a said heart lying in each through opening of each step and extending into the elongated through opening of the wedge collar, said wedge heart having an upper vertex adjacent and spaced down from said upper end of said step's through opening and a lower vertex adjacent and spaced up from the bottom of the elongated through opening of said wedge collar, and providing two rope-engaging said grooves extending between and ending at said vertices, so that these rope-engaging grooves, when said wedge heart is fully wedged in place, lock the pair of ropes in place and prevent relative movement between them and said step, said wedge collar and said wedge heart, and fastening means extending through the bolt passages of each wedge collar and the bolt openings of each step and tightened in place to hold said wedge collar and wedge heart in place and lock said ropes in fixed position relative to said wedge heart, said step, and said wedge collar.

7. The ladder of claim 6 wherein said longitudinal, transverse, and diagonal members of said frame comprise square tubing.

8. The ladder of claim 6 having at intervals along said ropes a spreader step having a central portion like an aforesaid step but with a pair of outboard portions that include extended integral portions of said longitudinal frame members joined at their outboard ends by transverse frame members, said molded body being molded around said extended portions of said longitudinal frame portions and having openings through each said outboard portion between said extended portions to provide handholds, lightness, and wind passages therethrough.

9. The ladder of claim 8 wherein said spreader steps includes an additional diagonal member of said frame outboard of each said bracket and near it.

10. A replacement wedge collar for a ladder of claim 6, each said replacement wedge collar having a slot on one side leading into said through opening.

11. The collar of claim 10 wherein the side opposite said slot is greatly thickened.

12. A replacement step for a ladder of claim 6 like the step set forth therein with the addition of:

a diagonal slot adjacent to and parallel to each said diagonal frame member, and through both said frame and step, a filler member filing said slot, and fastening means extending transversely through said step and through said filler member to hold it in place removably.

13. A rope ladder of the type having a series of ladder steps, each with an upper surface and a lower surface, two longitudinal edges and two end edges, and two spaced-apart pairs of ropes, the improvement wherein each said step has:

a unitary metal frame with a pair of longitudinal, square tubes joined by a pair of shorter transverse square tubes and strengthened by a pair of diagonal square tubes each extending from one end portion of a transverse tube on the inboard side thereof, to the longitudinal tube that is joined to the opposite end of the transverse tube, all said longitudinal, transverse, and diagonal tubes being welded together, said frame also having at each end a metal bracket resting atop and welded to and bridging across the pair of longitudinal tubes outboard of said transverse tubes, each said bracket having vertical portions leading up to an upper plate portion, which defines a generally rectangular opening, a molded hard elastomer body molded around said frame and having an integral collar portion at each end molded around a said bracket, said body having two spaced-apart vertical through openings, one through each collar portion and the body therebelow and in line with the openings through said brackets, each said through opening being narrow at its upper end for closely confining said ropes and being much wider than that where it emerges from said lower surface, each through opening tapering inwardly from bottom to top, each said step having two vertical bolt openings therethrough, one adjacent each of the opposite ends of each said through opening, extending through both said frame brackets and longitudinal tubes and through said body, a pair of separate wedge collars for each said step, one at each end of and below said step and bearing up against it, each said wedge collar having a through opening whose upper end is approximately the same width as said step's through opening where it emerges from its lower surface, said collar's through opening tapering inwardly therefrom down to a narrow portion at the lower end for closely confining the two ropes, each said wedge collar having vertical bolt passages therethrough aligned with the bolt openings through said step, a generally diamond-shaped wedge heart in between the said ropes of each pair of ropes, a said heart lying in each through opening of each step and extending into the elongated through opening of the wedge collar, said wedge heart having an upper vertex adjacent and spaced down from said upper end of said step's through opening and a lower vertex adjacent and spaced up from the bottom of the elongated through opening of said wedge collar, and providing two rope-engaging side grooves extending between and ending at said vertices, so that these rope-engaging grooves, when said wedge heart is fully wedges in place, lock the pair of ropes in place and prevent relative movement between them and said step, said wedge collar and said wedge heart, and bolts extending through the bolt passages of each wedge collar and the bolt openings of each step with nuts tightened on them to hold said wedge collar and wedge heart in place and lock said ropes in fixed position relative to said wedge heart, said step, and said wedge collar.

14. A step for a rope ladder of the type having spaced-apart pairs of ropes, comprising a metal frame with a pair of longitudinal members joined by a pair of shorter transverse members spaced in from the ends and strengthened by a pair of diagonal members, and having at each end a metal bracket bridging across the pair of longitudinal members and having vertical portions leading to an upper plate portion, which defines a generally rectangular opening, and a molded hard elastomer body molded around said frame and having a collar portion at each end molded around a said bracket, said body having a through opening through each collar portion and the body therebelow and in line with the openings through said brackets, each said through opening being narrow at its upper end for closely confining said pair of ropes and widening out toward its lower end, each through opening tapering inwardly from bottom to top, each said step having vertical bolt openings therethrough adjacent each said through opening.

15. The step of claim 14 wherein said metal frame comprises a pair of longitudinal, square tubes joined by a pair of shorter transverse square tubes and strengthened by a pair of diagonal square tubes each extending from one end portion of a transverse tube on the inboard side thereof, to the longitudinal tube that is joined to the opposite end of the transverse tube, all said longitudinal, transverse, and diagonal tubes being welded together, said metal bracket resting atop and welded to the pair of longitudinal tubes outboard of said transverse tubes.

16. The step of claim 15 having a pair of outboard portions that include extended integral portions of said longitudinal frame members joined at their outboard ends by transverse frame members, said molded body being molded around said extended portions of said longitudinal frame portions and having openings through each said outboard portion between said extended portions to provide handholds, lightness, and wind passages therethrough.

17. The step of claim 16 wherein said outboard portions include additional diagonal frame members, one outboard of each said bracket and adjacent to it.

18. The step of claim 15 having a diagonal slot adjacent to and parallel to each said diagonal frame member, and through both said frame and step, a filler member filing said slot, and fastening means extending transversely through said step and through said filler member to hold it in place removably.

19. A replacement step for a rope ladder of the type having a series of ladder steps spaced-apart pairs of ropes, comprising:

a metal frame with a pair of longitudinal members joined by a pair of shorter transverse members spaced in from the ends and strengthened by a pair of diagonal members, and having at each end a metal bracket bridging across the pair of longitudinal members and having vertical portions leading to an upper plate portion, which defines a generally rectangular opening, a molded hard elastomer body molded around said frame and having a collar portion at each end molded around a said bracket, said body having a through opening through each collar portion and the body therebelow and in line with the openings through said brackets, each said through opening being narrow at its upper end for closely confining said two ropes and widening out toward its lower end, each through opening tapering inwardly from bottom to top, each said step having vertical bolt openings therethrough adjacent each said through opening, a diagonal slot ajdacent to and parallel to each said diagonal frame member, and through both said frame and step, a filler member filling said slot, and fastening means extending transversely through said step and through said filler member to hold it in place removably.

20. The replacement step of claim 19 wherein said frame members are square tubes, all the longitudinal, transverse, and diagonal tubes being welded together, said slot cutting across one said longitudinal tube and one said transverse tube, each on said fastening means extending though both and longitudinal tubes and through the hollow center of a said transverse tube.

21. A replacement wedge collar for a rope ladder, comprising a metal member defining a through opening tapering inwardly therefrom down from its upper end to a narrow portion at its lower end, each said wedge collar having vertical bolt passages therethrough, and a slot on one side leading into said through opening, the said collar opposite said slot being greatly thickened.

* * * * *